United States Patent [19]

Nanjyo et al.

[11] Patent Number: 4,708,112

[45] Date of Patent: Nov. 24, 1987

[54] ELECTRONIC GOVERNOR FOR AN INTERNAL COMBUSTION ENGINE

[75] Inventors: Hirotoshi Nanjyo; Hidetoshi Suzuki, both of Shizuoka, Japan

[73] Assignee: Kokusan Denki Co. Ltd., Numazu, Japan

[21] Appl. No.: 884,049

[22] Filed: Jul. 10, 1986

[30] Foreign Application Priority Data

Jul. 11, 1985 [JP] Japan ..... 60-151280
Jul. 30, 1985 [JP] Japan ..... 60-168190

[51] Int. Cl.[4] ..... F02D 41/38
[52] U.S. Cl. ..... 123/357; 290/40 A
[58] Field of Search ..... 290/40; 123/357, 358

[56] References Cited

U.S. PATENT DOCUMENTS

| | | | |
|---|---|---|---|
| 4,368,705 | 1/1983 | Stevenson | 123/357 |
| 4,416,232 | 11/1983 | Shiozaki | 123/357 |
| 4,426,982 | 1/1984 | Lehner | 123/357 |
| 4,566,068 | 1/1986 | Iwasaki | 123/357 |
| 4,566,414 | 1/1986 | Sieber | 123/357 |
| 4,601,270 | 7/1986 | Kimberley | 123/357 |
| 4,619,234 | 10/1986 | Okamoto | 123/357 |

*Primary Examiner*—Ronald B. Cox

*Attorney, Agent, or Firm*—Pearne, Gordon, McCoy & Granger

[57] ABSTRACT

In an electronic governor for an internal combustion engine provided with a fuel injection pump having a control rack for adjusting fuel supply, a constant speed control signal Vnd for control to maintain the deviation of the actual speed N from a designated speed No within a permissible range, and a maximum rack position control signal VLd for control to maintain the deviation of the rack position from the maximum position for the particular speed N within a permissible range, are inputted into a control mode selector, which outputs the constant speed control signal Vnd when a speed detection signal Vn is not smaller than a designated speed signal Vno, or when the speed detection signal Vn is smaller than the designated speed signal Vno and the rack is below the maximum position, and outputs the maximum rack position control signal VLd when the speed detection signal Vn is smaller than the designated speed signal Vno and rack is above the maximum position. The output of the control mode selector is used to control the rack to cause the deviation of the actual speed N from the designated speed No or the rack position from the maximum position to be within a certain range.

7 Claims, 12 Drawing Figures

FIG. 7A
FIG. 7B
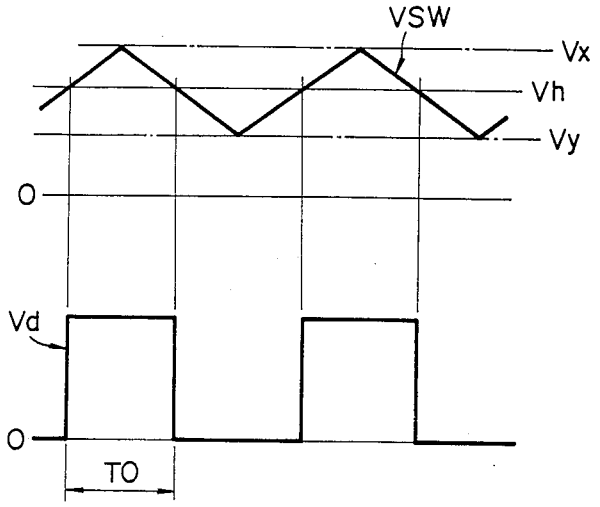
FIG. 8
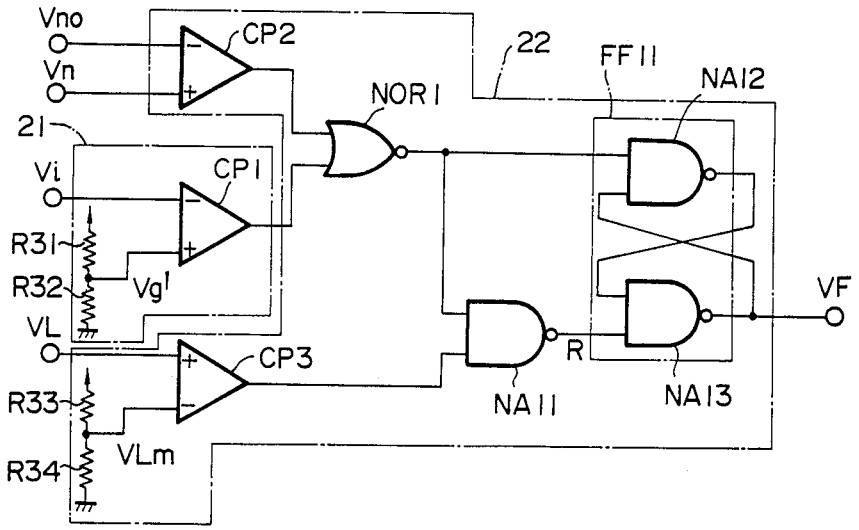

ELECTRONIC GOVERNOR FOR AN INTERNAL COMBUSTION ENGINE

BACKGROUND OF THE INVENTION

The present invention relates to an electronic governor for an internal combustion engine for controlling the rotational speed of the internal combustion engine by controlling a control rack of a fuel injection pump.

In an internal combustion engine, such as a diesel engine where fuel is supplied by a fuel injection pump, the rotational speed (rpm) is controlled by controlling the position of a control rack (fuel injection amount adjustment member).

An example of an electronic governor for controlling the rotational speed by controlling the position of the rack of the fuel injection pump for use in an internal combustion engine is shown in Japanese Patent Application Laying-open No. 171037/1982. In this prior art electronic governor, a rotational speed detection signal obtained from a sensor for detecting the rotational speed of the engine, a rack position detection signal obtained from a sensor detecting the position of the rack of the fuel injection pump, and an accelerator position detection signal obtained from a sensor for detecting the position of the accelrator manipulator are used to calculate the target position of the rack required to obtain the desired rotational speed of the engine as indicated by the accelrator position. A control voltage required for positioning the rack at the target position is generated and is used to drive an actuator for actuating the rack, thereby moving the rack to the target position.

It is desirable to maintain substantially constant the power which is proportional to the rotational speed multiplied by the torque dependent on the fuel supply amount. Accordingly, there is an upper limit to the amount of fuel which can be supplied at any given rotational speed. Generally, in the area above the rotational speed giving the maximum torque, the maximum fuel supply amount is decreased as the engine rotational speed is increased. Since the maximum fuel supply amount is determined for each rotational speed, the maximum rack position is determined for each rotational speed where a fuel injection pump is used, the maximum rack position being defined as the permissible limit position toward the open position side (greater fuel supply side) of the rack. For this reason, the above-mentioned prior art device calculates, from the rack position detection signal and the rotational speed detection signal, the maximum rack position and controls the rack so that its position does not exceed the maximum rack position.

The engine characteristic obtained with the use of the above-described prior art system is shown in FIG. 1. If the load torque T is increased from zero to the full load torque To, while the accelerator is kept at the position where the engine rotational speed N for the no load (torque T=0) is at Ns, engine rotational speed N is decreased to No (<Ns). This characteristic is called droop characteristic. The rack position reaches the maximum rack position at the maximum load torque. With greater load torque, the engine rotational speed N decreases along the maximum rack position characteristic, i.e., with the rack position being controlled at the maximum rack position.

The above-described governor is not satisfactory for applications where the rotational speed should be kept constant against load variation, because it has a droop characteristic and is not capable of providing constant speed characteristic.

For instance, internal combustion engines used for driving welder generator feeding both the welding load and other loads in general are required to have a characteristic shown in FIG.2. This welder generator has switchable (reconnectible) windings so that it can operate both as a constant-frequency AC generator of 50/60 Hz and a welder drive generator. When it is used as an AC generator of 50/60 Hz, the rotational speed (the output frequency of the generator) should be kept constant against variation in the load torque (load of the generator). The range of load variation is from noload to full-load To, and it is required that the engine rotational speed be kept at a constant value No. When the internal combustion engine is used for driving a welder drive generator, the internal combustion engine is operated at or near its full load torque To, and it is required that the rack position be kept at the maximum rack position for the particular rotational speed to produce the maximum output.

As has been described, the conventional electronic governor cannot provide a constant speed characteristic, so that when it is used for driving an AC generator, the output frequency cannot be kept constant.

Another consideration to be made in the design of a governor for an internal combustion engine is the requirement of increasing the fuel supply at the time of starting the engine, i.e., until the starting is completed. For implementing this increase in fuel supply at the time of engine start, it is necessary to detect when the engine is being started, i.e., in a starting condition. In a conventional electronic governor, such a detection is made upon finding of the engine rotational speed below a predetermined rotational speed Nsu which is set below the rotational speed of the starter motor.

A problem encountered by this conventional governor is that if the engine rotational speed becomes low because of increase in the load torque, the starting fuel supply increase control is effected, so that the fuel supply is increased. As a result, the output torque of the engine is increased and hence the rotational speed is increased. When the rotational speed becomes above the predetermined rotational speed Nsu, the fuel supply increase is terminated, so that the output torque again falls and the rotational speed again falls below Nsu. Thus, the unstable operation continues in which the rotational speed fluctuates about Nsu. This may cause over-heating of the engine.

SUMMARY OF THE INVENTION

An object of the invention is to provide an electronic governor for an internal combustion engine which can perform both constant speed control and maximum rack position control.

Another object of the invention is to enable fuel supply increase at the time of starting the engine without causing unstable operation of the engine.

According to the invention, there is provided an electronic governor for an internal combustion engine provided with a fuel injection pump for supplying fuel to the engine and having a control rack for adjusting fuel injection amount, said electronic governor comprising, means providing a designated speed signal Vno indicative of the desired rotational speed No of the internal combustion engine, a speed detector detecting the rotational speed N of the internal combustion engine and producing the speed detection signal Vn indicative of the rotational speed N, a rack position detector detecting the position of the rack and producing a rack position detection signal VL indicative of the position of the rack, a speed deviation operation circuit responsive to the speed detection signal Vn for producing a constant speed control signal Vnd for effecting control to maintain the deviation of the actual rotational speed N from the designated rotational speed No within a permissible range, a rack position deviation operation circuit responsive to the speed detection signal Vn and the rack position detection signal VL for producing a maximum rack position control signal VLd for effecting control to maintain the deviation of the rack position from the maximum rack position for the particular rotational speed N within a permissible range, a control mode selector responsive to the constant speed control signal Vnd and the maximum rack position control signal VLd for producing the constant speed control signal Vnd when the speed detection signal Vn is not smaller than the designated speed signal Vno, producing the constant speed control signal Vnd when the speed detection signal Vn is smaller than the designated speed signal Vno and the rack position is below the maximum rack position, and producing the maximum rack position control signal VLd when the speed detection signal Vn is smaller than the designated speed signal Vno and rack position is above the maximum rack position, and means responsive to the output of the control mode selector for controlling the rack to cause the deviation of the actual rotational speed N from the designated rotational speed No or the rack position from the maximum rack position to be within a certain range.

BRIEF DESCRIPTION OF THE DRAWINGS

In the accompanying drawings:

FIGS. 7A and 7B are time charts showing waveforms of the sawtooth signals and the output of the drive circuit; and FIG. 8 is a circuit diagram showing examples of the various circuits shown in FIG. 6.

DETAILED DESCRIPTION OF THE PREFERRED EMBODIMENTS

Figure 3:
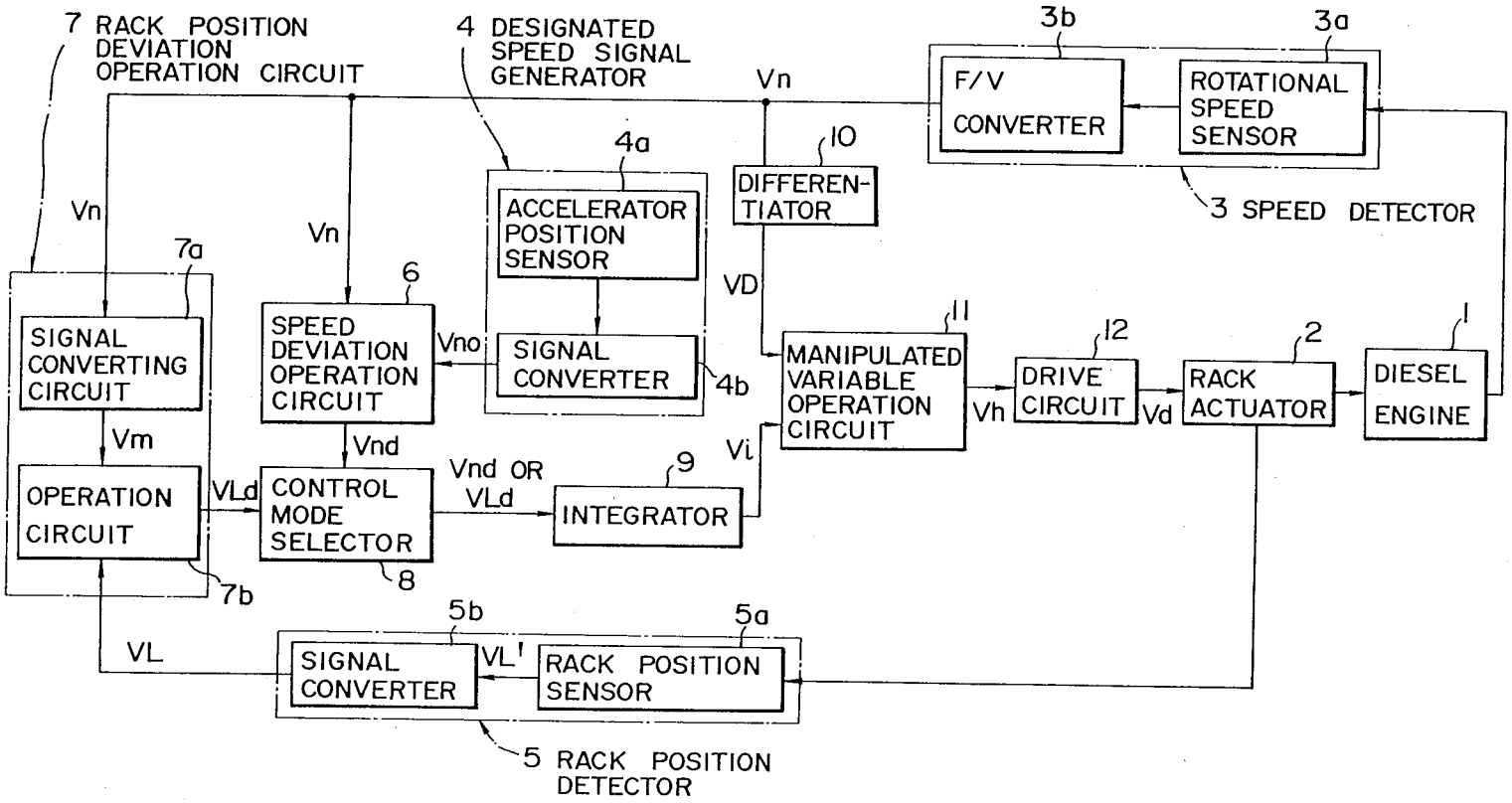
FIG. 3 is a block diagram showing an embodiment of an electronic governor according to the invention.

Referring now more particularly to FIG. 3, there is shown an embodiment of an electronic governor according to the invention. The electronic governor is for an internal combustion engine, which in this embodiment is a diesel engine. The internal combustion engine is provided with a fuel injection pump having a control rack for adjusting the fuel injection amount.

A rack actuator 2 is electrically driven to actuate the rack. The rack actuator 2 may be of the type having an electric motor as a driver or of the type having an electromagnetic plunger as a driver.

Figure 1:
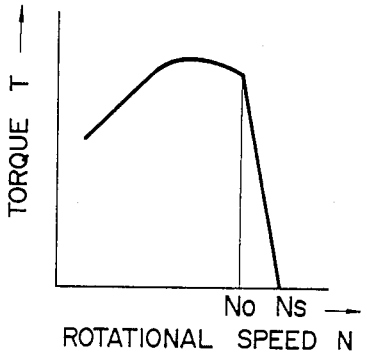
FIG.1 is a graph showing a relationship between the torque and the rotational speed obtained by use of a conventional governor.
Figure 2:
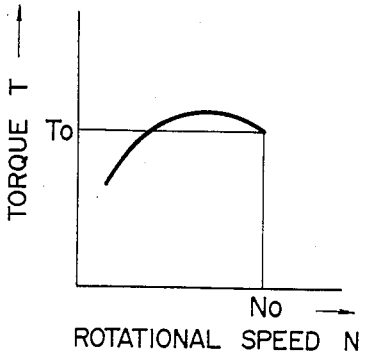
FIG.2 is a graph showing a characteristic required of an internal combustion engine driving a welder generator.
Figure 4A:
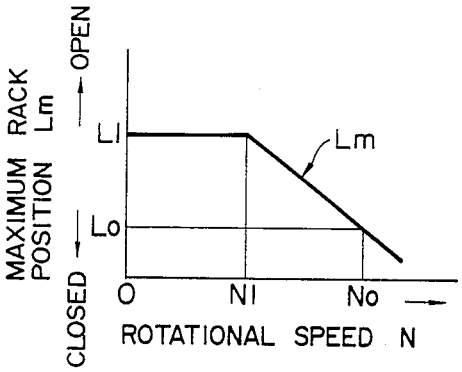
FIGS. 4A–4D are graphs respectively showing the relationship between the maximum rack position and the rotational speed, the relationship between the torque and the rotational speed, the relationship between the speed detection signals and the rotational speed, and the relationship between the rack position detection signal and the rack position.

In the embodiment, it is assumed that there is a relation as shown in FIG. 4A, between the rotational speed N and the maximum rack position Lm. As shown, in the region below a certain preset rotational speed N1, the control is made in such a manner that the rack position is kept at the maximum rack position set at a certain position L1 close to the open position side. In the region above N1, the rack position is linearly decreased toward the closed position side with increase in the rotational speed. The engine torque is determined by the rack position of the fuel injection pump. When the rack position is changed toward the open position side (the side for a greater fuel injection amount) the engine torque is increased. The rotational speed N1 is the rotational speed at which the maximum torque Tm (FIG. 4B) is produced. If the maximum rack position Lm is set above L1, the engine may be damaged.

In the region above N1, the maximum rack position is made closer to the closed position side so as to reduce the maximum fuel injection amount with increase of the rotational speed, thereby to maintain constant the maximum engine output (rotational speed×maximum torque). In the example illustrated, the rack position is so controlled as not to exceed the maximum rack position Lm at each rotational speed.

Figure 4C:
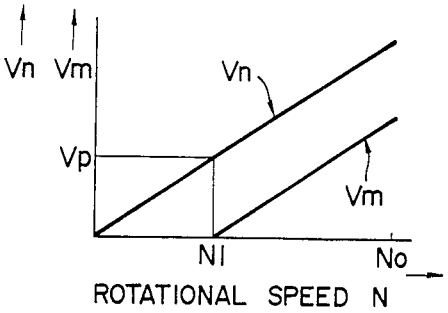
Figure 4B:
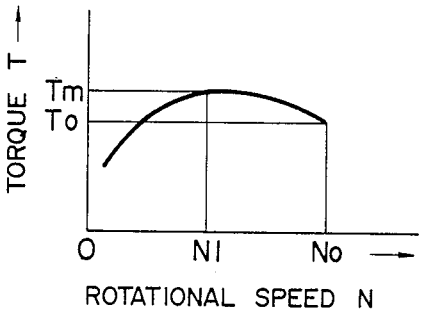

In the following description, No in FIG. 4A is a designated rotational speed designated by an accelerator manipulator, not shown. The rack position is controlled so as not to exceed the maximum rack position at No (the rack position producing the maximum torque To at No). As shown in FIG. 4B, in the range between no load and the maximum load torque To at No, the rack position is adjusted (varied) between the closed position and the maximum rack position Lo to maintain the engine rotational speed N at the designated rotational speed No. Thus, constant speed rotation control is achieved.

In the range where the load torque exceeds the maximum load torque To, maximum rack position control is conducted in which the rack position is controlled at the maximum rack position for each rotational speed. In the range where the maximum rack position control is conducted, the engine rotational speed varies responsive to the load variation, but the rack position is kept at the maximum rack position for the particular rotational speed.

A rotational speed sensor 3*a* detects the engine rotational speed, and may comprise a pulse generator whose output frequency is proportional to the engine rotational speed. A frequency-voltage converter (F/V converter) 3*b* converts the output frequency of the sensor 3*a* into a voltage signal Vn, called a speed detection signal, proportional to the engine rotational speed. The rotational speed sensor 3a and the F/V converter 3b in combination form a speed detector 3.

An accelerator position sensor 4a detects the position of the accelerator manipulator setting the rotational speed of the engine 1. A signal converter 4b converts the output of the sensor 4a into a designated speed signal Vno indicating the designated rotational speed corresponding to the position of the accelerator manipulator. The accelerator position sensor 4a and the signal converter 4b in combination form a designated speed signal generator 4.

A rack position sensor 5a detects the rack position of a fuel injection pump. The output of the rack position sensor 5a is fed to a signal converter 5b. The rack position sensor 5a produces a detection signal VL' which linearly varies with the rack position L. The signal converter 5b converts the detection signal VL' into a rack position detection signal VL which is at zero at the closed position. The rack position sensor 5a and the signal converter 5b in combination form a rack position detector 5. The rack position sensor 5a may comprise a displacement sensor such as a potentiometer. The signal converter 5b may be formed to suit the particular rack position sensor 5a used in combination therewith.

The designated speed signal Vno and the speed detection signal Vn are inputted into a speed deviation operation circuit 6, which produces, responsive to the signals Vno and Vn, a constant speed control signal Vnd, in accordance with:

$$Vnd = a(Vn - Vno)$$

where a is a constant. The signal Vnd is for maintaining the deviation of the actual rotational speed from the designated rotational speed within a permissible range.

A rack position deviation operation circuit 7 receives the speed detection signal Vn and the rack position detection signal VL and produces a maximum rack position control signal VLd for effecting control to maintain the deviation of the rack position from the maximum rack position for the particular rotational speed within a permissible range. The rack position deviation operation circuit 7 of this embodiment comprises a signal converter 7a for converting the speed detection signal Vn into a maximum rack position control speed information signal Vm and an operation circuit 7b responsive to the speed information signal Vm and the rack position detection signal VL for producing a maximum rack position control signal VLd.

In the illustrated embodiment, the maximum rack position control signal VLd is determined by $$Vld = b(Vm + VL) - Vr$$

where b represents a coefficient which can be 1, and

Vr represents a constant value.

By effecting control to maintain the deviation VLd within a permissible range, the deviaiton of the actual rack position from the maximum rack position can be maintained within a permissible range. In other words, by effecting control to decrease the rack position detection signal VL against increase in the speed information signal Vm and to increase the rack position detection signal VL against decrease in the speed information signal Vm, a control characteristic is obtained in which the maximum rack position is decreased with increase in the rotational speed N, this control characteristic being obtained in the range above the set rotational speed N1 shown in FIG. 4A. It is for this purpose to use a signal which starts rising at the set rotational speed N1 as shown in FIG. 4C. The speed information signal Vm can be obtained by subtracting, from the speed detection signal Vn, the magnitude Vp of the speed detection signal at the set rotational speed N1.

The signal Vnd from the speed deviation operation circuit 6 and the signal VLd from the rack position deviation operation circuit 7 are inputted into a control mode selector 8, which selects either of the inputs in accordance with predetermined conditions, and outputs the selected inputs. The conditions upon which the control mode selector 8 makes selection are as follows:

(a) When the engine rotational speed N is not smaller than the designated rotational speed No and the speed signal Vn is not smaller than the designated speed signal Vno, the constant speed control signal Vnd is selected.

(b) When the engine rotational speed N is smaller than the designated rotational speed No and the speed detection signal Vn is smaller than the designated speed signal Vno, and the rack position is below (closer to the closed position side than) the maximum rack position, then the constant speed control signal Vnd is selected.

(c) When the speed detection signal Vn is smaller than the designated speed signal Vno and the rack position exceeds (is closer to the open position side than) the maximum rack position, then the maximum rack position control signal VLd is selected.

The output Vnd or VLd from the control mode selector 8 is inputted into and integrated in an ingtegrator 9. The integral signal Vi from the integrator 9 is inputted into a manipulated variable operation circuit 11.

In addition, in the embodiment illustrated, the speed detection signal Vn is inputted into and differentiated at a differentiator 10, whose output, i.e., a differential signal VD is also inputted into the manipulated variable operation circuit 11.

The manipulated variable operation circuit 11 determines a manipulated variable for the rack actuator 2 to maintain the deviation of the rack position from the maximum rack position within a permissible range. The signal indicative of the manipulated variable is inputted into a drive circuit 12, which drives the rack actuator 2 in accordance with the manipulated variable as determined by the manipulated variable operation circuit 11, to move the rack to the desired position.

In the embodiment illustrated, the speed detector 3 produces the speed detection signal Vn proportional to the engine rotational speed N as shown in FIG. 4C. The speed detection signal Vn is inputted into the speed deviation operation circuit 6, the rack position deviation operation circuit 7 and the differentiator 10.

Figure 4D:
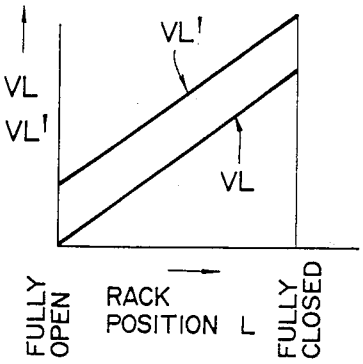

The rack position detector 5 produces the rack position detection signal VL which varies linearly from the fully closed position to the fully open position of the rack position L, as shown in FIG. 4D. The rack position detection signal VL is inputted into the rack position deviation operation circuit 7.

When the accelerator manipulator is fixed at a position for giving the designated rotational speed No, the designated speed signal generator 4 produces a designated speed signal Vno indicating that the designated rotational speed is No, and the speed deviation operation circuit 6 produces the constant speed control signal $$Vnd = a(Vn - Vno)$$

corresponding to the deviation of the speed detection signal Vn from the designated speed signal Vno. The rack position deviation operation circuit 7 produces the maximum rack position control signal $$VLd=b(Vm+VL)-Vr$$

When the engine rotational speed N becomes larger than the designated rotational speed No, the speed signal Vn becomes larger than the designated speed signal Vno, so that control mode selector 8 outputs the constant speed control signal Vnd. The integrator 9 outputs the integral signal $$Vi=K1\int(Vn+Vno)a\,dt$$

where K1 represents a constant. The manipulated variable operation circuit 11 receives the integral signal Vi and determines the manipulated variable for the rack actuator 2 to maintain the deviation of the actual engine rotational speed N from the designated rotational speed No within a permissible range (and, preferrably, to make the deviation zero), and supplies the signal indicative of the determined manipulated variable to the drive circuit 12.

The manipulated variable operation circuit 11 also responds to the output of the differentiator 10 produced by speed variation to output a signal for driving the rack actuator 2 in a direction for compensating the speed variation.

Upon occurrence of the differential signal VD, the drive circuit 12 starts compensating operation of driving the rack actuator 2 in a direction to cancel the speed variation, in accordance with the signal from the manipulated variable operation circuit 11. Subsequently, upon occurrence of the integral signal Vi, and when the manipulated variable operation circuit 11 outputs the manipulated variable which it has determined, the drive circuit 12 drives the rack actuator 2 in accordance with the manipulated variable. The rack thereby moves toward the closed position side to the position ( appropriate for causing the difference between N and No to be within the permissible range ), so that the rotational speed N approaches the designated rotational speed No.

When the load increases, the rotational speed N becomes smaller than the designated rotational speed No so that the speed detection signal Vn becomes smaller than the designated speed signal Vno. If the load torque T is smaller than the maximum torque To for the designated rotational speed No, the rack position is below the maximum rack position, so that the control mode selector 8 outputs the constant speed control signal Vnd. The manipulated variable operation circuit 11 therefore determines the manipulated variable for causing the difference between the rotational speed N and the designated rotational speed No to be within the permissible range and supplies the thus-determined manipulated variable to the drive circuit 12, which drives the rack actuator 2 in accordance with the manipulated variable. In the range where the load torque T is smaller than the maximum torque To for the designated rotational speed No, the engine rotational speed is maintained at the designated rotational speed No, by means of the operations described above.

In the embodiment described above, the integrator 9 and the differentiator 10 are provided and the manipulated variable is determined in accordance with the integral of the control signal and the differential of the rotational speed detection value, to achieve PID (proportional—integral—differential) control action.

Incorporating the integral control action reduces the offset. Addition of the differential control action reduces the settling time since if is possible to start the compensating operation before the integral signal is produced. However, it may be so arranged that the differentiator 10 is omitted and PI control is effected.

When the load torque T exceeds the maximum torque To for the designated rotational speed No, the rotational speed N becomes smaller than the designated rotational speed No and hence the speed detection signal Vn becomes smaller than designated speed signal Vno, the rack position tends to exceeds the maximum rack position (toward greater fuel injection amount side). The control mode selector 8 then outputs the maximum rack position control signal $$VLd=b(Vm+VL)-Vr$$

and the integrator 9 outputs the integral signal $$Vi=K2\int\{(Vm+VL)-Vr\}dt$$

where K2 is a constant. The manipulated variable operation circuit 11 receives the integral signal Vi and determines the manipulated variable for the rack actuator 2 to make $$b(Vm+VL)=Vr$$

and supplies the manipulated variable to the drive circuit 12.

The drive circuit 12 thereby drives the rack actuator 2 to cause the deviation of the rack position from the maximum rack position to be within the permissible range. In other words, when the rotational speed N is decreased, the speed information signal Vm becomes smaller. The rack actuator 2 is therefore driven to increase the rack position detection signal VL, i.e., to displace the rack toward the open position side, and the rack is made to stop at the position where $$b(Vm+VL)=Vr$$

it being so preset that such a position is the maximum rack position. When the rotational speed N becomes high, the speed information signal Vm is increased. The rack actuator 2 is so driven as to reduce the rack position detection signal VL, i.e., to displace the rack toward the closed position side, and the rack is made to stop at the position where $$b(Vm+VL)=\mathrm{Vr}$$

Figure 5:
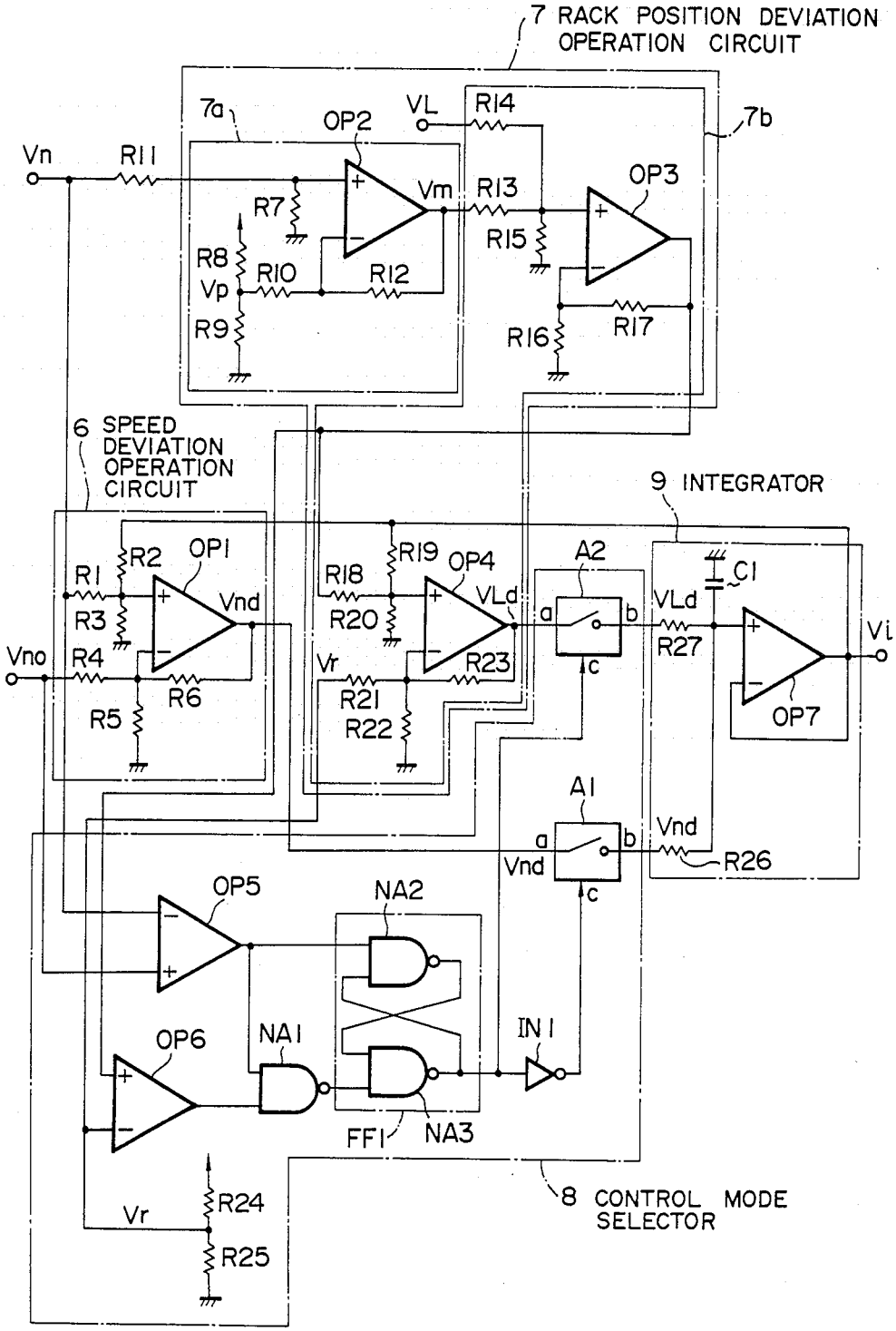
FIG. 5 is a circuit diagram showing examples of the various circuits of FIG. 3.

FIG. 5 shows examples of the speed deviation operation circuit 6, the rack position deviation operation circuit 7, the control mode selector 8 and the integrator 9 of FIG. 3. The illustrated example of the speed deviation operation circuit 6 comprises an operational amplifier OP1 and resistors R1–R6. The operational amplifier receives, at its positive input terminal and negative input terminal, the speed detection signal Vn and the designated speed signal Vno and outputs, at its output terminal, the constant-speed control signal $$Vnd=a(Vn-Vno)$$

The integral signal Vi fed back through the integrator is added to this control signal, as will be later described.

The signal converter *7a* of the rack position deviation operation circuit 7 comprises an operational amplifier OP2 and resistors R7–R12. The operation circuit *7b* comprises operational amplifiers OP3 and OP4, resistors R13–R23, and resistors R24–R25 which also form part of the control mode selector 8. The operational amplifier OP2 of the rack position deviation operation circuit 7 receives, at its positive input terminal, the speed detection signal Vn. A voltage Vp obtained by dividing, by means of the resistors R8 and R9, a voltage from a DC power supply, not shown, is fed to the negative input terminal of the operational amplifier OP2. Obtained at output of the operational amplifier OP2 is therefore the maximum rack position control speed information signal Vm corresponding to the difference between the speed detection signal voltage Vn and the fixed voltage Vp.

The speed information signal Vm and the rack position detection signal VL are inputted into the positive input terminal of the operational amplifier OP3, and obtained at the output of the operational amplifier OP3 is the signal b (Vm+VL). This signal is supplied to the positive input terminal of the operational amplifier OP4. A reference voltage Vr obtained by dividing, by means of the resistors R24 and R25, a voltage from a DC power supply, not shown, is supplied to the negative input terminal of the operational amplifier OP4. Obtained at the output of the operational amplifier OP4 is the maximum rack position control signal $$VLd = b(Vm + VL) - Vr$$

The integral signal Vi fed back through the integrator is also added to this control signal.

The control mode selector 8 comprises operational amplifiers OP5 and OP6, a NAND gate NA1, a flip-flop circuit FF1 fromed of NAND gates NA1 and NA3, a voltage divider formed of resistors R24 and R25, an invertor IN1, and analog switches A1 and A2. Each of the analog switches A1 and A2 comprises an input terminal a, an output terminal b and a control terminal c. When the potential at the control terminal c is high, the impedance between the input and output terminals a and b is low (substantially zero), i.e., the swich is conductive. When the potential at the control terminal c is low, the impedance between the input and output terminals a and b is high, i.e., the swich is nonconductive.

When the constant speed control is to be effected (the rack position is closer to the closed position side than the maximum rack position for the particular rotational speed N), $$b(Vm + VL) \leqq Vr,$$

so that the potential of the output of the operational amplifier OP6 is low (substantially at the ground potential). Since engine rotational speed keeps fluctuating about the designated rotational speed No, the potential at the output of the operational amplifier OP5 repeatedly changes between the low level (substantially the ground potential) and the high level. The output of the NAND gate NA1 is high since the output of the operational amplifier OP6 is zero. The output of the flip-flop circuit FF1 is therefore low. The control terminal c of the analog switch A1 is high, and the control terminal c of the analog switch A2 is low, so that the analog switch A1 conducts while the analog switch A2 is non-conductive. The constant speed control signal Vnd is therefore outputted through the analog switch A1.

When the maximum rack position control is to be effected, $$b(Vm + VL) > Vr,$$

so that the output of the operational amplifier OP6 is high. In this state, when the speed detection signal Vn becomes smaller than the designated speed signal Vno (Vn<Vno ), the flip-flop circuit FF1 is inverted, so that the analog switch A1 becomes nonconductive while the analog switch A2 becomes conductive. The maximum rack position control signal VLd is therefore outputted through the analog switch A2.

When the speed detection signal Vn becomes larger than the designated speed signal Vno (Vn>Vno), the output of the operational amplifier OP5 becomes low, and hence the output of the NAND gate NA1 becomes high, so that the output of the flip-flop circuit FF1 becomes low. Accordingly, the analog switch A2 becomes nonconductive while the analog switch A1 becomes conductive. The constant speed control signal Vnd is therefore outputted.

Thus, when the speed detection signal Vn becomes larger than the designated speed signal Vno, the constant speed control is resumed.

The constant speed control signal Vnd or the maximum rack position control signal VLd is inputted to the integrator 9. The integrator 9 comprises resistors R26 and R27, a capacitor C1 and an operational amplifier OP7 used as a buffer.

The control signal Vnd or VLd is fed through the resistors R26 or R27 to the capacitor C1, which is thereby charged to achieve integration. To impart holding function, the output of the integrator 9 is fed back to the operational amplifiers OP1 and OP4. The actual constant speed control signal Vnd is therefore given by $$Vnd = Vi + (Vn - Vno)a$$

The maximum rack position control signal VLd is given by $$VLd = Vi + b(Vm + VL) - Vr$$

The operation of the governor incorporating the circuits of FIG. 5 is as follows: In the range of from no-load to maximum load torque To in FIG. 4B, the analog switch A1 is closed so that the constant speed control signal Vnd is outputted. The integrator 9 integrates $$Vnd = Vi + (Vn - Vno)a$$

The manipulated variable operation circuit 11 receives the integral signal to determine the manipulated variable. The system is stabilized when Vn=Vno. The integrator 9 holds the output produced at that time.

When the load torque T exceeds the maximum torque To for the rotational speed No, the analog switch A2 is closed so that the control signal $$VLd = Vi + b(Vm + VL) - Vr$$

is outputted and is integrated by the integrator 9.

The manipulated variable operation circuit 11 receives the integral signal and determines the manipulated variable to make $$b(Vm+VL)=Vr$$

The rack is thereby moved toward the maximum rack position. When the rack position becomes the maximum rack position and $$b(Vm+VL)=Vr,$$

then the system is stabilized. The integrator 9 holds the output produced at that time.

In the embodiment described, the rack position deviation operation circuit 7 outputs the control signal $$VLd=b(Vm+VL)-Vr$$

But the signal converter *7a* may be replaced by a function generator which produces a maximum rack position signal VLm which varies as shown in FIG. 4A against the rotational speed N, in which case the deviation between the output (maximum rack position signal) VLm from the function generator and the rack position detection signal VL may be determined by the operation circuit *7b*, to obtain the control signal $$VLd=a(VL-VLm)$$

and this control signal may be inputted to the control mode selector 8. In this case, the manipulated variable operation circuit 11 determines the manipulated variable to make the deviation between the rack position detection signal VL and the maximum rack position signal VLm within the permissible range.

Thus, the governor of the embodiment described above has a speed deviation operation circuit, a rack position deviation operation circuit and a control mode selector, and the constant speed control signal or the maximum rack position control signal is selectively outputted, so that constant speed control and maximum rack position control can be achieved. The governor is therefore suitable for applications where a characteristic of maintaining the rotational speed N constant against variation in load, and a characteristic of maintaining the rack position at the maximum rack position for the particular rotational speed N to provide a torque which is substantially the full-load torque. An example of such an application is an internal combustion engine for driving both a welder load and a load in general.

Figure 6:
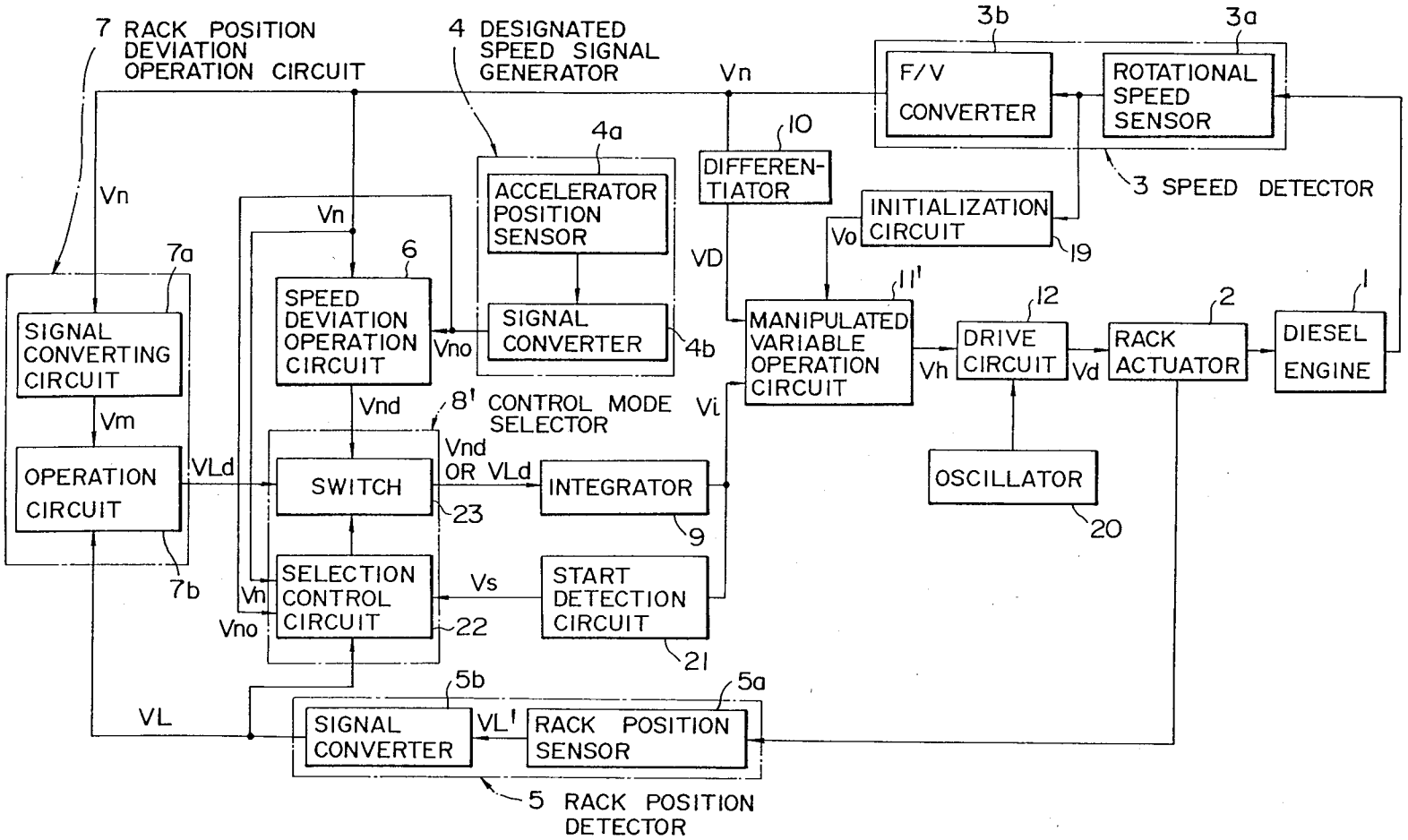
FIG. 6 is a block diagram showing another embodiment of the invention.

FIG. 6 shows another embodiment of the invention. The reference numerals and marks identical with those in FIG. 3 denote identical or similar members and physical quantitics.

As shown, the electric governor of FIG. 6 is generally identical to that of FIG. 3. But it differs in the following respects.

A manipulated variable operation circuit 11' of this embodiment determines the sum of or difference between the integral signal Vi and the differential signal VD to determine the manipulated variable signal Vh indicative of the manipulated variable for the rack actuator 2 to maintain the deviation of the rotational speed N from the designated rotational speed No or the rack position L from the maximum rack position Lm within a permissible range.

An oscillator 20 provides a sawtooth wave signal Vsw repeatedly changing between an upper limit Vx and a lower limit Vy as shown in FIG. 7A. The manipulated variable signal Vh is supplied, together with the sawtooth wave output from the oscillator 20 to the drive circuit 12. In the example illustrated, the drive circuit 12 compares the manipulated variable signal Vh with the sawtooth wave Vsw and produces a rectangular drive signal Vd, as shown in FIG. 7B, which is high during the period when the sawtooth wave Vsw is above the manpulated variable signal Vh. The duty of the drive signal Vd is zero when the manipulated variable signal Vh is equal to or greater than the upper limit, and is 100% when the manipulated variable signal Vh is equal to the lower limit Vy.

In the embodiment illustrated, while the drive signal Vd is present, the rack actuator 2 is energized, and the rack is moved toward the fully open position side. The rack is therefore moved toward the open position side in an amount proportional to the time of energization of the rack actuator 2. When energization of the rack actuator 2 is terminated (the duty of the drive signal Vd becomes zero) the rack returns to the fully closed position by the action of a return spring. The manipulated variable signal Vh varies between the upper limit Vx and the lower limit Vy to make the deviation zero, as a result of which the duty of the drive signal Vd varies to move the rack to the desired position.

A start detection circuit 21 receives the output (integrall signal) Vi from the integrator 9. The start detection circuit 21 comprises a comparator comparing the integral signal Vi with a lower limit value Vy' under normal operating condition, and outputs a start detection signal Vs when the integral signal Vi is smaller than the lower limit (used as a reference signal).

Alternatively, the start detection circuit 21 may be connected to compare the manipulated variable signal Vh with the lower limit Vy to detect the starting condition. But the use of the integral signal Vi is advantageous since the manipulated variable signal Vh contains minute fluctuations where the differential signal VD is inputted to the manipulated variable operation circuit 11'.

A control mode selector 8' of this embodiment comprises a selection control circuit 22 and a switch 23. The selection control circuit 22 is responsive to the rack position detection signal VL, the speed detection signal Vn, the designated speed signal Vno and the start detection signal Vs for controlling the switch 23 as to the selection of control mode. The criteria of selection of control mode are as follows:

(a') When the engine rotational speed N is not smaller than the designated rotational speed No and the speed detection signal Vn is not smaller than the designated speed signal Vno, the constant speed control signal Vnd is selected.

(b') When the rotational speed N is smaller than the designated rotational speed No and the speed detection signal Vn is smaller than the designated speed signal Vno, and the rack position is below the maximum rack position, the constant speed control signal Vnd is selected.

(c') When the start detection signal Vs is inputted, the constant speed control signal Vnd is selected.

(d') When the speed detection signal Vn is smaller than the designated speed signal Vno and the rack position is above the maximum rack position (toward the greater fuel injection amount side ), the maximum rack position control signal VLd is selected.

An initialization circuit 19 produces an initialization signal Vo when the speed sensor 3*a* is not producing an output, i.e., when the rotational speed N of the internal combustion engine is zero.

When the engine stops, the output of the speed sensor 3*a* disappears, so that the initialization circuit 19 produces the initialization signal Vo. Responsive to the initialization signal Vo, the manipulated variable operation circuit 11' brings the manipulated variable signal Vh above the upper limit Vx to make the duty of the drive signal Vd zero, and terminates the energization of the rack actuator 2. The rack is thereby returned to the fully closed position. This movement of the rack is fed back by means of the rack position detector 5 to the selection control circuit 22. The rack position is below the maximum rack position, and the speed detection signal Vn is smaller than the designated speed signal Vno, so that the condition of (b') is satisfied. The selection control circuit 22 therefore controls the switch 23 to select the constant speed control signal Vnd.

When the starter motor is thereafter driven, the initialization circuit 19 ceases to produce the initialization signal Vo, so that the manipulated variable operation circuit 11' stops the initializing operation for holding the rack at the fully closed position and produces the manipulated variable signal Vh in accordance with the integral signal Vi which is an integral of the constant speed control signal Vnd.

At the time of starting the engine, the integral signal Vi which is the time integral of the speed deviation is smaller than the lower limit Vy', so that the start detection circuit 21 produces the start detection signal Vs. The selection control circuit 22 therefore controls the switch 23 to select the constant speed control signal Vnd. While the start detection signal Vs is present, the integral signal Vi is smaller than the lower limit Vy', so that the duty of the drive signal is at 100%. The rack is therefore held at the fully open position, and hence the fuel supply to the engine is increased. Thus, fuel supply increase at the time of engine start is accomplished. When the engine starting is completed and the integral signal Vi becomes greater than the lower limit, the start detection signal Vs disappears, and fuel supply increase is terminated and the constant speed control is commenced.

FIG. 8 shows an examples of the start detection circuit 21 and the selection control circuit 22 of FIG. 6.

The start detection circuit 21 of this example comprises a comparator CP1 and a series connection of resistors R31 and R32. A constant DC voltage is applied from a power supply, not shown, across the the series connection of the resistors R31 and R32, and a reference signal indicating the lower limit Vy' of the integral Vi for normal operation is obtained across the resistor R32. The integral signal Vi and the reference signal indicating the lower limit Vy' are respectively inputted into the negative and positive input terminals of the comparator CP1, which thereby produces a start detection signal Vs at its output terminal.

The selection control circuit 22 comprises comparators CP2 and CP3, a series connection of resistors R33 and R34, a NOR gate NOR1, a NAND gate NA11, and a flip-flop circuit FF11 comprising NAND gates NA12 and NA13. A constant DC voltage is applied across the series connection of the resistors R33 and R34. The designated speed signal Vno and the speed detection signal Vn are respectively inputted into the negative and positive input terminals of the comparator CP2. The rack position signal VL is inputted into the positive input terminal of the comparator CP3, while the maximum rack position signal VLm obtained across the resistor R34 is inputted into the negative input terminal of the comparator CP3.

When the integral signal Vi is smaller than the lower limit Vy', the logical state of the output of the comparator CP1 is at "1" ( the starting detection signal Vs is outputted ). At the time of starting an engine, the speed detection signal Vn is smaller than the designated speed signal Vno, so that the logical state of the output of the comparator CP2 is at "0". Also, at the time of starting an engine, the rack is initially at the fully closed position, and the rack position signal VL is smaller than the maximum rack position signal VLm, so that the logical state of the output of the comparator CP3 is at "0". In this state, the logical state of the output of the NOR gate NOR1 is at "0", and logical state of the output of the NAND gate NA11 is at "H". The logical state of the reset terminal R of the flip-flop circuit FF11 is therefore at "1" and the logical state of the output VF of the flip-flop circuit FF11 is at "0". The switch 23 selects the constant speed control signal Vnd and feeds it to the integrator 9. Accordingly, when the start detection signal Vs is present (when the logical state of the output of the comparator CP1 is at "1"), the constant speed control signal Vnd is inputted into the integrator 9, and the rack is therefore kept at the fully open position.

When the starting of the engine is completed and the integral signal exceeds the lower limits Vy', the logical state of the output of the comparator CP1 is thereafter kept at "0". If, in this state, the speed detection signal Vn is smaller than the designated speed signal Vno, the logical state of the output of the comparator CP2 becomes "0", so that the logical state of the output of the NOR gate NOR1 becomes "1" and the logical state of the set terminal S of the flip-flop circuit FF11 becomes "1". The rack position is then at the fully open position, and is above the maximum rack position, so that the rack position signal VL is larger than the maximum rack position signal VLm. The logical state of the output of the comparator CP3 is therefore at "1". Accordingly, the logical state of the output of the NAND gate NA11 is at "0" and the logical state of the output of the flip-flop circuit FF11 becomes "1". The switch 23 selects and outputs the maximum rack position control signal VLd. The rack position therefore recedes to the maximum rack position.

If, in this state, the engine rotational speed N exceeds the designated rotational speed No, the speed detection signal Vn becomes larger than the designated speed signal Vno, so that the logical state of the output of the comparator CP2 becomes "1". The logical state of the output of the NOR gate NOR1 becomes "0" and the logical state of the output of the NAND gate NA11 becomes "1". The logical state of the output VF of the flip-flop circuit FF11 becomes "0", and the switch 23 therefore feeds the constant speed control signal Vnd to the integrator 9.

When the load is increased and the rack position exceeds the maximum rack position Lm, and the engine rotational speed becomes lower than the designated rotational speed No, the logical state of the output of the comparator CP3 becomes "1" and the logical state of the output of the comparator CP2 becomes "0", so that the logical state of the output of the NOR gate NOR1 becomes "1" and the logical state of the output of the NAND gate NA11 becomes "0", and the logical state of the output VF of the flip-flop circuit FF11 becomes "1". The switch 23 then feeds the maximum rack position control signal VLd to the integrator 9.

In the embodiment which has been described, the speed detection signal Vn and the designated speed signal Vno are supplied to the selection control circuit 22, which compares the two signals to make judgement as to which of the engine rotational speed and the designated rotational speed No is larger. The arrangement may alternatively be such that the control signal Vnd is inputted into the selection control circuit 22 which detects the sign (polarity) of the control to make make judgement as to which of the engine rotational speed and the designated rotational speed No is larger.

As has been described, according to the embodiment of FIG. 6, the starting condition is detected upon finding that the integral signal from the integrator which integrates the deviation, or the manipulated variable from the manipulated variable operation circuit 11 is below the lower limit under normal operating condition. Erroneous finding of starting condition during normal operation of the engine and hence erroneous implementation of starting fuel injection amount increase control can be prevented, and unstable operation of the engine can be avoided.

What is claimed is:

1. An electronic governor for an internal combustion engine provided with a fuel injection pump for supplying fuel to the engine and having a control rack for adjusting fuel injection amount, said electronic governor comprising, means providing a designated speed signal Vno indicative of the desired rotational speed No fo the internal combustion engine, a speed detector detecting the rotational speed N of the internal combustion engine and producing the speed detection signal Vn indicative of the rotational speed N, a rack position detector detecting the position of the rack and producing a rack position detection signal VL indicative of the position of the rack, a speed deviation operation circuit responsive to the speed detection signal Vn for producing a constant speed control signal Vnd for effecting control to maintain the deviation of the actual rotational speed N from the designated rotational speed No within a permissible range, a rack position deviation operation circuit resposive to the speed detection signal Vn and the rack position detection signal VL for producing a maximum rack position control signal VLd for effecting control to maintain the deviation of the rack position from the maximum rack position for the particular rotational speed N within a permissible range, a control mode selector responsive to the constant speed control signal Vnd and the maximum rack position control signal VLd for producing the constant speed control signal Vnd when the speed detection signal Vn is not smaller than the designated speed signal Vno, producing the constant speed control signal Vnd when the speed detection signal Vn is smaller than the designated speed signal Vno and the rack position is below the maximum rack position, and producing the maximum rack position control signal VLd when the speed detection signal Vn is smaller than the designated speed signal Vno and rack position is above the maximum rack position, and means responsive to the output of the control mode selector for controlling the rack to cause the deviation of the actual rotational speed N from the designated rotational speed No or the rack position from the maximum rack position to be within a certain range.

2. An electronic governor according to claim 1, wherein said designated speed signal providing means comprises a designated speed signal generator detecting the position of an accelerator manipulator giving the designated rotational speed No of the internal combustion engine and producing the designated speed signal Vno indicative of the designated rotational speed No in accordance with the position of the accelerator manipulator.

3. An electronic governor according to claim 1, wherein said rack control means comprises a rack actuator electrically driven for actuating said rack, a manipulated variable operation circuit responsive to the output of the control mode selector for determining the manipulated variable for the rack actuator for causing the deviation of the actual rotational speed N from the designated rotational speed No or the rack position from the maximum rack position to be within a certain range, and a drive circuit for driving the rack actuator in accordance with the manipulated variable determined by the manipulated variable operation circuit.

4. An electronic governor according to claim 3, wherein said rack control means further comprises an integrator for integrating the output of the control mode selector, said manipulated variable operation circuit being connected to receive the output of the control mode selector through said integrator.

5. An electronic governor according to claim 4, further comprising:

a start detection circuit for judging whether or not the internal combustion engine is in a starting condition and producing a start detection signal when it finds that the internal combustion engine is in the starting condition, said start detection circuit comprising a comparator responsive to the manipulated variable signal or the integral signal for comparing the manipulated variable signal or the integral signal with a reference signal corresponding to the lower limit of the manipulated variable signal or the integral signal under normal condition and producing the start detection signal when the manipulated variable signal or the integral signal is below the lower limit, said manipulated variable operation circuit causing said drive circuit to drive the rack actuator to move the rack to the fully open position when the start detection circuit produces the start detection signal.

6. An electronic governor according to claim 5, further comprising an initialization circuit for producing an initialization signal when the internal combustion engine is not rotating, said manipulated variable operation circuit determining the manipulated variable for causing the rack actuator to drive the rack to the fully closed position when the initialization signal is produced.

7. An electronic governor according to claim 6, wherein said initialilzation circuit is connected to the speed detector and produces the initialization signal when the speed detection signal indicates that the rotational speed is zero.

* * * * *